US006510898B1

(12) United States Patent
Buytaert

(10) Patent No.: US 6,510,898 B1
(45) Date of Patent: Jan. 28, 2003

(54) POSITIONING ASSEMBLY

(75) Inventor: Jean P. Buytaert, Houston, TX (US)

(73) Assignees: Weatherford/Lamb, Inc., Houston, TX (US); Target Well Control Limited, Aberdeen (GB)

( * ) Notice: Subject to any disclaimer, the term of this patent is extended or adjusted under 35 U.S.C. 154(b) by 0 days.

(21) Appl. No.: 09/333,073

(22) Filed: Jun. 14, 1999

Related U.S. Application Data

(63) Continuation-in-part of application No. 09/213,163, filed on Dec. 17, 1998.

(30) Foreign Application Priority Data

Dec. 17, 1997 (GB) ..... 9726524
Jan. 9, 1998 (GB) ..... 9800344

(51) Int. Cl.[7] ..... E21B 23/00
(52) U.S. Cl. ..... 166/381; 166/117.5; 166/240
(58) Field of Search ..... 166/381, 50, 313, 166/117.5, 117.6, 241, 240

(56) References Cited

U.S. PATENT DOCUMENTS 5,862,859 A * 1/1999 Speed et al. ..... 166/117.5
6,003,621 A * 12/1999 Murray ..... 166/117.5
6,012,527 A * 1/2000 Nitis et al. ..... 166/313
6,082,453 A * 7/2000 Bakke ..... 166/240
6,089,319 A * 7/2000 Singleton ..... 166/117.5
6,142,225 A * 11/2000 McCorry et al. ..... 166/117.6

FOREIGN PATENT DOCUMENTS

EP 0834643 4/1998 ..... E21B/23/02

* cited by examiner

*Primary Examiner*—William Neuder
(74) *Attorney, Agent, or Firm*—Howrey Simon Arnold & White, LLP

(57) ABSTRACT

A system is disclosed for positioning downhole tools in a borehole such as a cased or lined oilwell, wherein the system is adapted to control the vertical and rotational position of the tool within the borehole. The system uses a plurality of guide slots or ledges which form a spiral on the inner surface of a tubular.

23 Claims, 6 Drawing Sheets

POSITIONING ASSEMBLY

This is a continuation-in-part of application Ser. No. 09/213,163 filed on Dec. 17, 1998, which claims priority from application Ser. No. 9726524.3 filed in Great Britain on Dec. 17, 1997, and application Ser. No. 9800344.5 filed in Great Britain on Jan. 9, 1998.

BACKGROUND OF THE INVENTION

1. Field of the Invention

This invention relates to a wellbore positioning system for locating a downhole tool in a borehole.

2. Description of the Related Art

A common problem faced when drilling oil wells is how to locate a downhole tool such as a whipstock inside a casing section repeatedly at the same depth and at the same orientation, for example in order to drill a deviated side track through a window in the casing. Several solutions to this problem have been found. The most basic is a muleshoe and key (see FIG. 1) where the key is set inside the casing in a fixed point and a muleshoe profile is machined into the tool being run, or into a separate muleshoe attachment fitted to the string. The muleshoe profile can alternatively be machined into the inner face of the casing (e.g. upside down with the apex pointing upwards), and a spring loaded key can be provided on the locating tool. In each case, the key comes to rest at a key seat machined into the wall of the muleshoe.

While the muleshoe allows rotational orientation and depth control of the whipstock or other downhole tool on the string, it does not allow multiple vertical locations to be located automatically. In addition, the key can become snagged on the apex of the muleshoe rather than on the key seat. Also, if the muleshoe is machined into the inner face of the casing, which is preferred, there is a loss of effective diameter, and a consequent weakening in the casing. Furthermore, the key seat can become filled with accumulated debris which can prevent proper seating of the key.

In an effort to address the problem of identifying multiple vertical locations, location systems such as the selective key setting tool have been devised. In this tool (shown in FIG. 2), a number of locating profiles are machined into the casing, each having a unique shape, and a locating tool with laterally extending spring-loaded keys is run through the casing until the keys match with the desired locating profile, at which point the keys engage the profile and further downward movement is resisted. While this allows the identification of a particular vertical location corresponding to the key, it does not orient the locating tool or whipstock rotationally.

SUMMARY OF INVENTION

According to the present invention there is provided a wellbore system for selectively locating a downhole tool in a wellbore casing or tubing comprising a plurality of positioning guides spaced in the wellbore casing or tubing at predetermined depths wherein each positioning guide has a unique profile for selectively receiving a matching profile key of a downhole tool, the guides for each key having a configuration which controls the depth and rotational position of its matching key. The control of the vertical and rotational position of the key thereby controls the vertical and rotational position of the member. The member can be a downhole assembly such as a running tool or a whipstock etc.

The invention also provides a method of selectively locating a downhole tool in a wellbore casing or tubing comprising the steps of:

a) placing a plurality of positioning guides at desired depths in the wellbore casing or tubing wherein each guide has a unique profile for selectively receiving a matching profile locating key, b) selecting the profile of a locating key for the downhole tool to match the profile of a desired positioning guide, and c) running the downhole tool to the desired positioning guide wherein the locating key engages the matching profile of the positioning guide which controls the depth and rotational position of the locating key to orient the downhole tool in a desired direction.

Preferably each key guide is a slot or a ledge, which in particular embodiments extend downwards and laterally. In a preferred embodiment the key guides are spiral slots, optionally covering a minimum of 450° of circumference.

By casing, we mean any downhole tubular such as casing, liner, drill pipe, or any functional equivalents.

It is an important aspect of the invention that each key guide only allows engagement of a particular key, such that the profile of the key only fits within the profile or width of the key guide such as the slot. In particular cases, there can be more than two key guides, and/or more than two keys, so that multiple outlets spaced vertically and rotationally from one another in the casing string can be identified and particular tools in the work string can be located at different rotational positions and at different depths throughout the string. In one embodiment, the keys can be spring loaded and/or retractable.

BRIEF DESCRIPTION OF THE DRAWINGS

An embodiment of the present invention will now be described by way of example, and with reference to the accompanying drawings, in which.

Figure 1A:
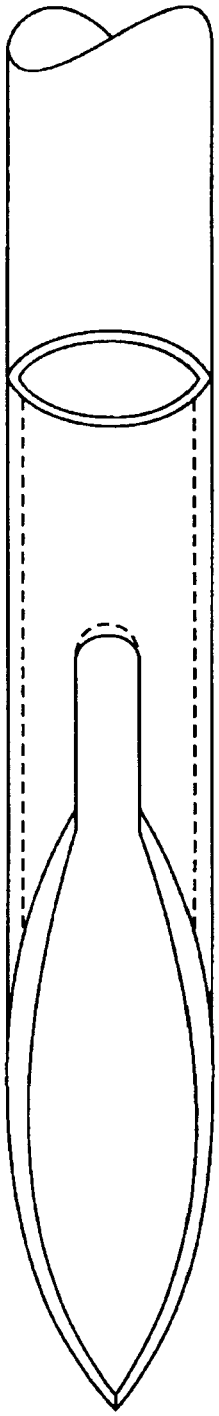
FIGS. 1A, 1B show a muleshoe arrangement of the prior art.
Figure 1B:
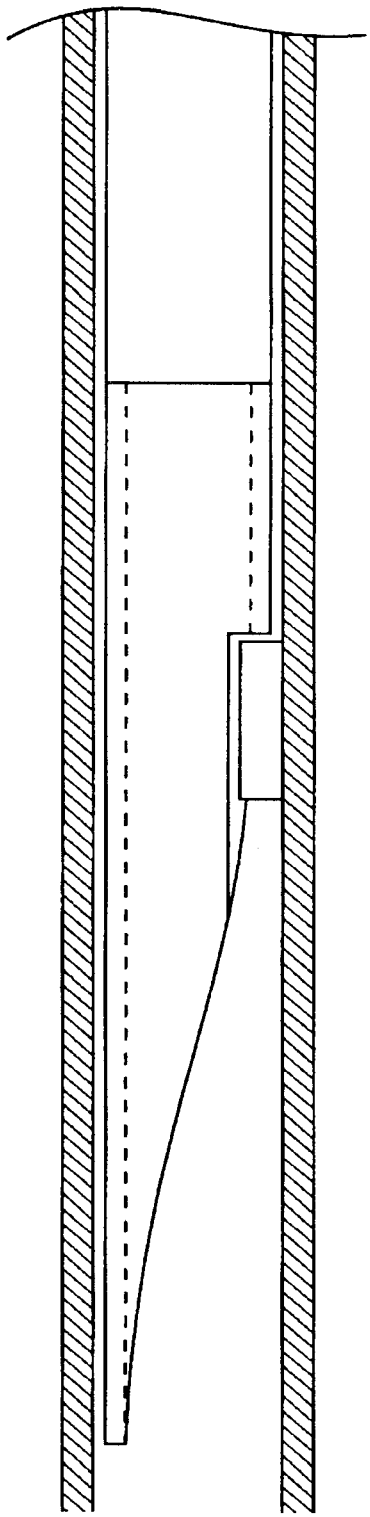
Figure 2:
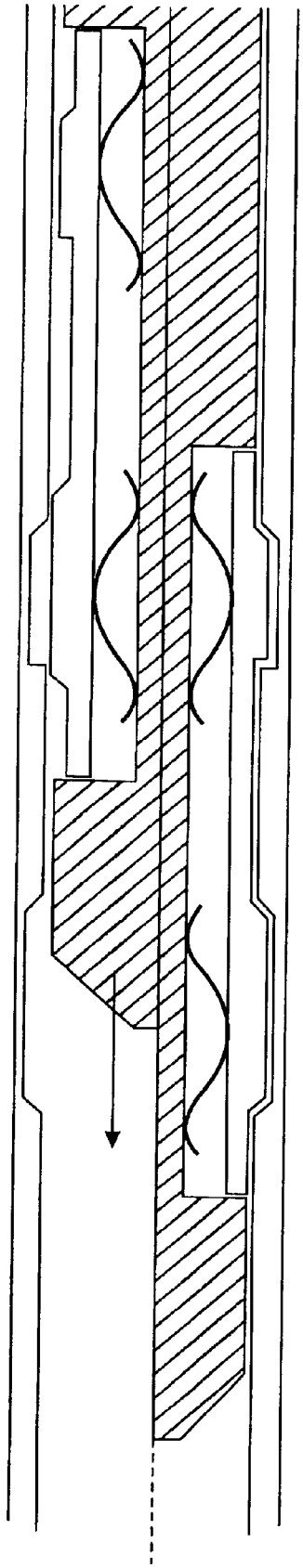
FIG. 2 shows a selective key locating system of the prior art.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 3, 4 and 5A and 5B, a system in accordance with one embodiment of the invention comprises a casing tubular 1 having spiral grooves 5 and 5' machined into its inner face. The grooves 5 and 5' are spaced around the inner circumference of the tubular 1 so that they start at opposite sides at 180° spacing. The spiral grooves 5 and 5' extend in a counter-clockwise direction in order to prevent the inadvertent backoff of threaded connections above during the impact of the key of the locating tool against the groove, and each has a predetermined width 5w and profile. In the system of the invention shown in FIGS. 3, 4 and 5A and 5B, a locating tool 7 is mounted on a whipstock 10 at the lower end of a work string (not shown). A spring located key 15 is carried on the locating tool 7, and comprises a laterally extending boss of a predetermined size to fit within the width 5w of the spiral groove 5. The spring loaded key 15 is received within a recess in the locating tool and is sprung laterally so that it abuts against the inner face of the casing 1 in normal operation of the tool.

In use, the whipstock 10 and locating tool 7 are inserted into a casing string by a conventional work string etc. (not shown) until the boss on the spring loaded key 15 engages the slot 5 in the casing 1. When the boss is located in the spiral slot, the movement of the whipstock 10 and locating tool 7 is restricted to a downward spiral movement until the boss engages at the rest location 5r at the end of the slot 5. The whipstock is oriented in relation to the locating tool such that when the boss on the key 15 is at the rest location 5r in the slot 5, the whipstock 10 is positioned to deflect a drill string (not shown) from above through a window 1w in the casing 1.

Figure 6:
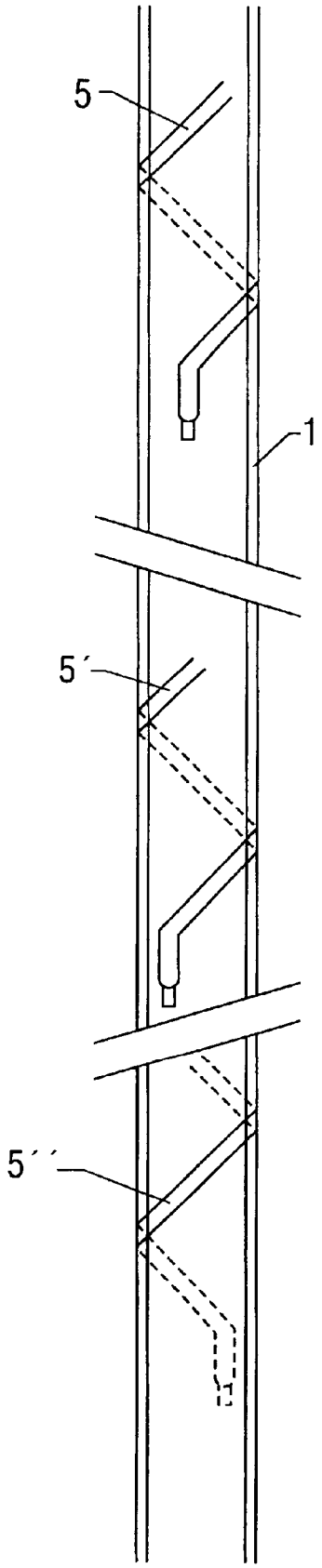
FIG. 6 shows the invention in a wellbore with multiple positioning guides.

Modifications and improvements can be incorporated without departing from the scope of the invention. For instance, three or more spiral grooves can be provided in the casing string at different rotational and/or vertical locations (i.e. at different depths). In the embodiment shown in FIG. 6, a plurality of positioning guides are spaced at different vertical depths in a wellbore casing. More paricularly, spiral slots 5, 5', 5" are spaced at different depths in casing 1. Different spiral slots can have differing widths or profiles so as to allow the engagement of only predetermined keys 15. By selecting the appropriate key on the location tool, the rotational and/or vertical positioning of the locating tool (and hence the whipstock, or other downhole tool) can be determined from the surface simply by inserting the locating tool 7 and whipstock 10 into the casing string and delivering the assembly to the appropriate depth until the key 15 engages in the slot.

Where separate slots are spaced vertically from one another, as shown in FIG. 6, any one slot will preferably be of narrower width or profile than the slot immediately below it, that the slot first engaged by the key on the locating tool being inserted will only be engaged if the profile of the key and slot fit, and larger keys intended for positioning further down the casing string will not engage with narrower slots at the upper levels of the casing string.

Figure 5A:
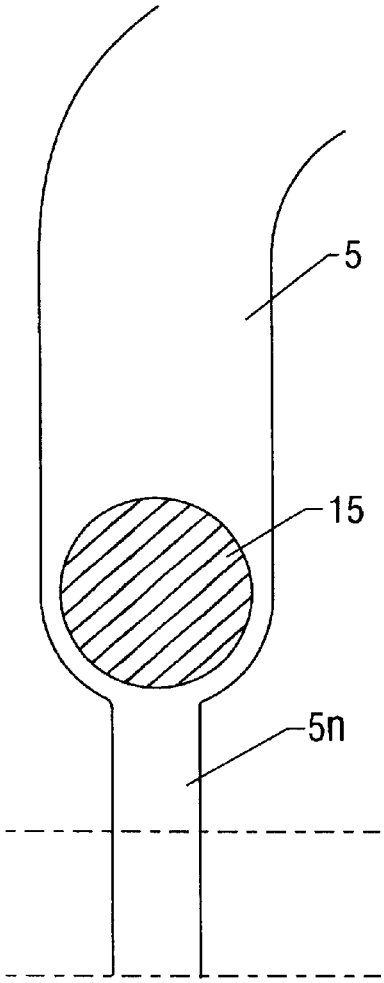
FIGS. 5A, 5B show the lower part of a groove in the FIG. 4 system.
Figure 5B:
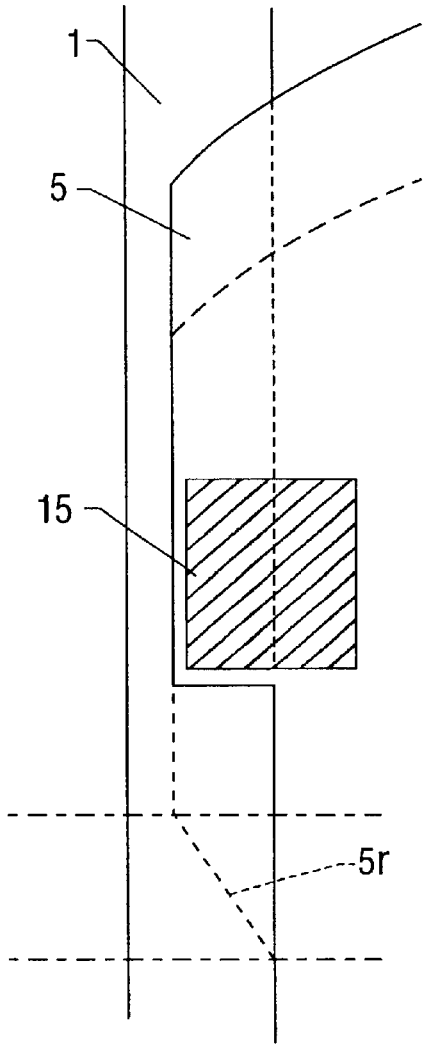

In certain embodiments (an example is shown in FIGS. 5A and 5B) the groove 5 has a profile at the key seat to facilitate self-cleaning of the groove 5. In the example shown in FIGS. 5A and 5B, these comprise a narrower portion of the groove 5n through which the key 15 cannot pass and/or a ramped profile 5r to prevent accumulation of debris at the key seat.

Figure 3:
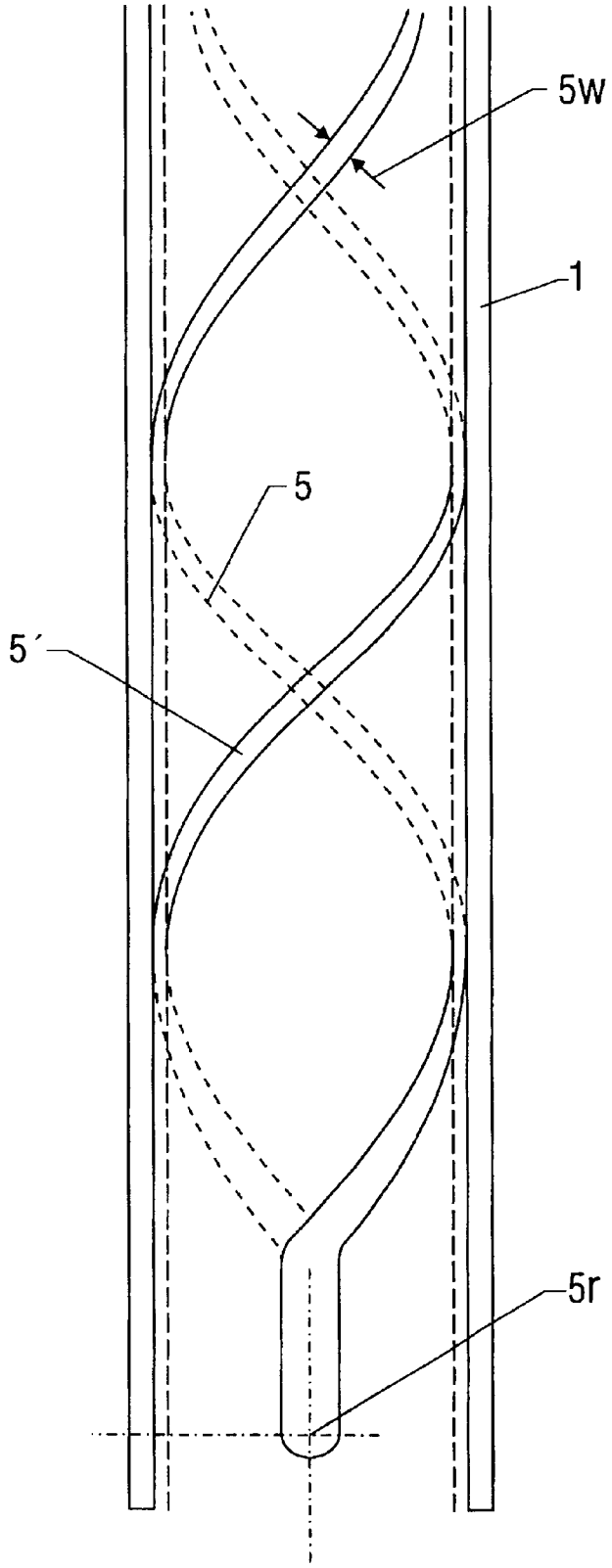
FIG. 3 shows a casing tubular embodying a spiral groove in accordance with one aspect of the invention.
Figure 4:
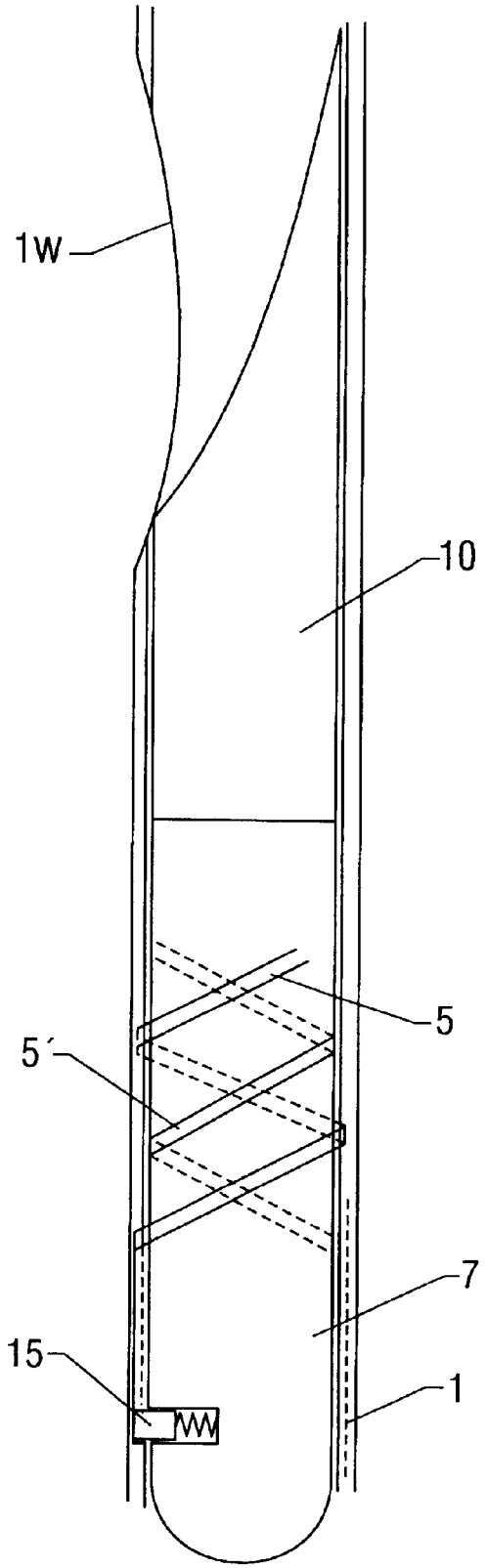
FIG. 4 shows a system of the invention being used to install a whipstock to deflect a drill string through a window in a casing tubular.

It is of course possible to have different profiles or widths of slot at the same vertical position, but at different rotational positions as shown in FIG. 3, so that by engaging the appropriate key into the slot, the rotational resting position of the locating tool can be specified even if the depth is not altered.

While the present invention has been particularly shown and described with reference to various illustrative embodiments thereof, it will be understood by those skilled in the art that various changes in form and details may be made without departing from the spirit and scope of the invention. The above-described embodiments are illustrative and should not be considered as limiting the scope of the present invention.

What is claimed is:

1. A wellbore system for selectively locating a downhole tool in a wellbore casing or tubing comprising a plurality of positioning guides spaced in the wellbore casing or tubing at predetermined depths wherein each positioning guide has a unique profile for selectively receiving a matching profile key of a downhole tool, the guide for each key having a configuration which controls the depth and rotational position of its matching key.

2. The wellbore system according to claim 1, wherein the positioning guides are slots which extend downwardly and laterally.

3. The wellbore system according to claim 1, wherein each positioning guide is spiral-shaped.

4. A wellbore system according to claim 1, wherein each positioning guide spirals around a minimum of 450° of circumference.

5. A wellbore system according to claim 1, wherein the keys are spring loaded, extendable and/or retractable.

6. A wellbore system according to claim 1, wherein each positioning guide is a slot with a unique width for selectively receiving a matching key of substantially the same width.

7. A wellbore system according to claim 1, wherein the downhole tool is a whipstock.

8. The wellbore system according to claim 1, wherein the profile for receiving the key comprises a seat, said seat comprising a narrower portion through which the key cannot pass which prevents accumulation of debris at the key seat.

9. The wellbore system according to claim 1, wherein the profile for receiving the key comprises a seat, said seat comprising a ramped profile which prevents accumulation of debris at the key seat.

10. A method of selectively locating a downhole tool in a wellbore casing or tubing comprising the steps of:

a) placing a plurality of positioning guides at desired depths in the wellbore casing or tubing wherein each guide has a unique profile for selectively receiving a matching profile locating key, b) selecting the profile of a locating key for the downhole tool to match the profile of a desired positioning guide, and c) running the downhole tool to the desired positioning guide wherein the locating key engages the matching profile of the positioning guide which controls the depth and rotational position of the locating key to orient the downhole tool in a desired direction.

11. The method of claim 10, wherein the positioning guides are slots which extend downwardly and laterally.

12. The method of claim 10, wherein each positioning guide is spiral-shaped.

13. The method of claim 10, wherein each positioning guide spirals around a minimum of about 450° of circumference.

14. The method of claim 10, wherein the locating key is spring loaded and/or retractable.

15. The method of claim 10, wherein the downhole tool is a whipstock.

16. The method of claim 10, wherein a second downhole tool with a different profiled locating key is located in a second positioning guide above the first positioning guide.

17. The method of claim 10, wherein each positioning guide is a slot with a unique width for selectively receiving a matching key of substantially the same width.

18. A wellbore system for selectively locating a downhole tool in a wellbore casing or tubing comprising a plurality of slots spaced along the inner circumference of the casing or tubing wherein each slot is positioned at a predetermined depth and orientation in the casing or tubing and where each slot has a different width or profile sized for selectively receiving a locating key having a similar width or profile on a downhole tool, the slot for a given locating key controlling the depth and rotational position of said key to orient a downhole tool with said key in a desired direction at a desired depth in the wellbore.

19. The wellbore system according to claim 18, wherein the plurality of slots are spaced at different depths in the casing or tubing.

20. The wellbore system according to claim 18, wherein each slot is spiral-shaped.

21. A wellbore system according to claim 18, wherein the keys are spring loaded, extendable and/or retractable.

22. A wellbore system according to claim 18, wherein each key is received within a recess on the downhole tool and is spring loaded and abuts against the inner face of the casing or tubing until it engages the slot with a similar width or profile.

23. A method of selectively locating a downhole tool in a wellbore casing or tubing comprising the steps of:

a) placing a plurality of slots along the inner circumference of the casing on tubing wherein each slot is placed at a predetermined depth and orientation and wherein each slot has a unique width or profile sized for selectively receiving a locating key having a similar width or profile, b) selecting a locating key for a downhole tool to fit the width or profile of a desired slot, and c) running the downhole tool into the casing or tubing until the locating key engages the desired slot and orients the downhole tool in a desired direction.

* * * * *